US005696338A

United States Patent [19]

Grissom

[11] Patent Number: 5,696,338

[45] Date of Patent: Dec. 9, 1997

[54] CELLO, BASS AND BASS DRUM FLOOR PROTECTOR

[76] Inventor: Pinkney O'Shaughnessy Grissom, 134 W. 73rd St., #3B, New York, N.Y. 10023

[21] Appl. No.: 494,183

[22] Filed: Jun. 23, 1995

[51] Int. Cl.[6] ..... G10D 3/00; G10G 5/00

[52] U.S. Cl. ..... 84/327; 84/280; 224/910; 248/188.9; 248/346.03

[58] Field of Search ..... 84/280, 327, 387 A; 248/188.9, 346.01, 346.03, 346.06; 224/910

[56] References Cited

U.S. PATENT DOCUMENTS

| | | | |
|---|---|---|---|
| 2,974,129 | 1/1961 | Fawick | 84/280 |
| 4,018,129 | 4/1977 | Hollander | 84/294 |
| 4,606,463 | 8/1986 | Stavis | 248/346 |
| 5,069,102 | 12/1991 | Wolf | 84/280 |

OTHER PUBLICATIONS

1993, Young Musicians, Inc., P.O. Box 48036, Ft. Worth, Texas 76148, advertisement for Cello Accessories, including catalog numbers and prices.

*Primary Examiner*—Cassandra C. Spyrou
*Attorney, Agent, or Firm*—Leydig Voit & Mayer, Ltd.

[57] ABSTRACT

An improved floor protector for cello, bass, and bass drum endpins including raised supports on the upper surface to support the endpin effectively at multiple points. Moreover, the floor protector has a curved dome-like top which enables the endpin to engage the floor protector at a variety of angles. Further, the bottom of the floor protector is shaped so that the floor protector may grip a variety of surfaces. Another aspect of the improved floor protector is the use of a self-healing and non-marring material, such as a thermoplastic polymer. The material reduces dulling of the endpin due to contact with the floor protector. Further, the material increases the longevity of the floor protector due to its ability to be punctured without tearing.

29 Claims, 2 Drawing Sheets

CELLO, BASS AND BASS DRUM FLOOR PROTECTOR

FIELD OF THE INVENTION

This invention relates generally to musical equipment and more particularly to a floor protector for use in conjunction with the endpin of a cello, bass, or bass drum.

BACKGROUND OF THE INVENTION

An endpin is used in a musical instrument, such as a cello, a bass or a bass drum, in order to provide stability when playing the instrument. The endpin, typically made of steel, is placed at the bottom of the instrument so that the instrument sits on the endpin when the instrument is upright stabilizes the instrument and permits height adjustment to adapt to the desires of the performer. However, use of the endpin causes a variety of problems. First, the endpin becomes dull due to constant contact with the floor. Second, the endpin may damage the floor surface due to its steel tip or be unstable and slide on very hard surfaces. Due to these problems associated with endpins, floor protectors were developed.

A typical floor protector for a cello or a bass consists of a spongy rubber material which surrounds a brass cup. The brass cup receives and holds the tip of the endpin. However, the typical floor protector has several drawbacks because of the design and the materials used. There are two problems associated with the typical floor protector design. First, the endpin is easily damaged due to contact with the floor protector. Over time, the steel tip of the endpin becomes dull as a result of the endpin rubbing against the brass cup and penetrating the spongy insert of the floor protector. Second, the brass cup of the typical floor protector is easily damaged by the steel endpin of the cello or bass, thereby destroying the structure of the floor protector.

Moreover, there are problems with the typical floor protector due to the type of materials used. Floor protectors often use a spongy material which increases the size of the floor protector. Floor protectors can be five inches in diameter which detracts from the aesthetic beauty of the instrument. Further, the bulky size of the floor protector makes it inconvenient to place the floor protector inside a cello or bass case in order to protect the case from damage caused by the endpin during transportation. Finally, the spongy material used in typical floor protectors easily falls apart, thereby reducing the effectiveness of the floor protector to grip various floor surfaces.

In addition, a typical floor protector for a bass drum is a piece of carpet placed under the bass drum. Similar to floor protectors for a cello or bass, the floor protector for the bass drum is bulky, easily destroyed, and not aesthetically pleasing.

SUMMARY OF THE INVENTION

It is a general object of the invention to develop an improved floor protector for use with the endpin of a bass, cello, or bass drum which is easier to use and more durable.

It is a related object of the invention to develop a floor protector which enhances support for the endpin and decreases potential damage to the floor protector.

It is still a further related object of the invention to develop a floor protector which is designed to optimally engage the endpin from a variety of angles.

It is still a further related object of the invention to develop a floor protector which is stable on a variety of surfaces.

It is still another related object of the invention to develop a floor protector which consists of a non-marring material and is integral and of simple manufacture.

It is yet still another object of the invention to develop a floor protector which may be punctured but will not split.

The present invention accomplishes these objectives and overcomes the drawbacks of the prior art through improvements in the design and in the material used. One important design improvement relates to the provision of raised supports on the floor protector. The raised supports can consist of semispherical bumps or projections which can be pyramidal, or any other configuration which receives the endpin. This design increases support for the endpin, or any other post-like or endpin-like device, while reducing the dulling effect on the steel endpin and decreasing the damage to the floor protector. The raised supports also provide multiple nest-like areas for the endpin to engage the floor protector.

Another design feature relates to the crowned upper surface of the floor protector. The curvature of the upper surface allows for the endpin to engage the floor protector from a variety of angles. Still another design feature relates to a concave bottom configuration which enables the floor protector to grip a variety of surfaces, from hardwood floors to carpets without slipping, tipping or other undesired displacement.

The floor protector also features a type of material which enhances and optimizes the features described above. The material is self-healing and non-marring, such as a thermoplastic including a polyvinyl chloride (PVC). The material acts synergistically with the other design features to protect the floor surface, and especially hardwood floors, due to its non-marring quality in the configuration described. Further, the chosen material can be punctured without splitting, increasing the longevity and effectiveness of the floor protector. Moreover, the material reduces the size of the floor protector contributing to its aesthetic quality and allowing placement of the floor protector inside a bass, cello or bass drum case.

These and other features and advantages of the invention will be more readily apparent upon reading the following description of the preferred embodiment of the invention and upon reference to the accompanying drawings wherein:

DESCRIPTION OF A PREFERRED EMBODIMENT

Figure 1:
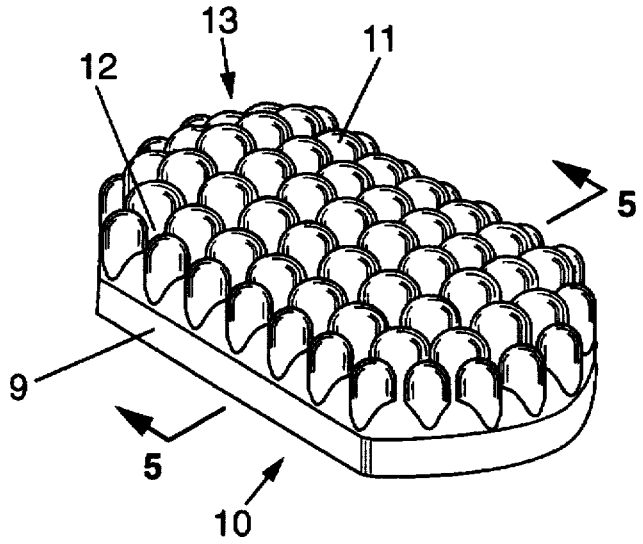
FIG. 1 is a perspective view of the floor protector.
Figure 3:
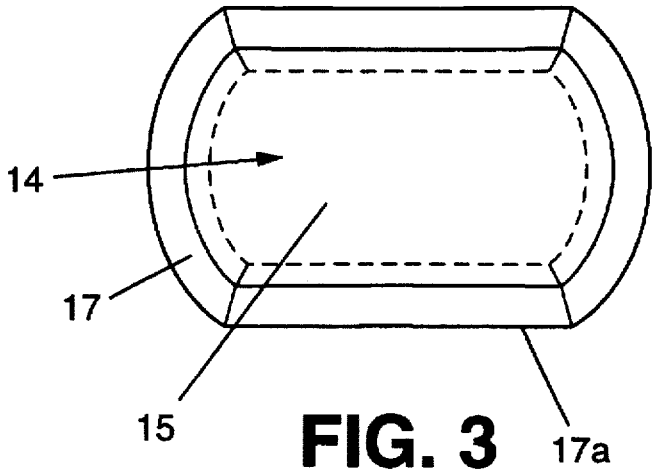
FIG. 3 is a plan view of the bottom of the floor protector.

Referring to the drawings, there is shown in FIG. 1 a floor protector 10 in accordance with the invention having a generally rectangular body 9. The protector 10 receives an endpin of a musical instrument such as a bass, a cello, a bass drum. The floor protector 10 may also receive any other post-like or endpin-like device. As shown in FIG. 3, the base surface 14 of body 9 may be rectangular, elliptical, circular or the like, provided it supports the body as described. All such shapes are referred to herein as "shaped body." The floor protector 10 has raised supports 11 which are formed on the upper surface 13 of the floor protector 10. The raised supports may be a variety of shapes arranged in various geometric configurations on the upper surface. The protector is preferably molded of flexible thermoplastic material as an integral unit.

In FIG. 1, the raised supports 11 are in the form of semispherical bumps. Semispherical is intended in the broad sense of "partially spherical"; "incompletely spherical"; and "to some extent spherical." Pockets, crevices or slots 12 are formed between the raised supports 11 thereby allowing the endpin to engage the floor protector 10 at multiple points. The multiple pockets or slots 12 nested among the raised supports 11 allow for increased longevity of the floor protector 10. If one on the raised supports 11 becomes damaged, other raised supports 11 may still support the endpin. Moreover, the raised supports 11 allow the endpin to engage the floor protector 10 at a variety of angles, as best shown in FIG. 2.

Figure 2:
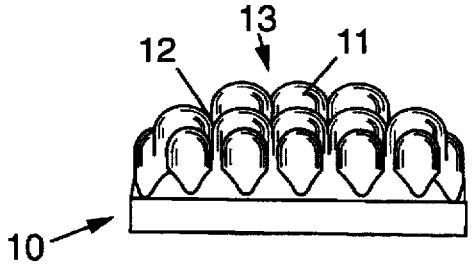
FIG. 2 is an approximate end view of the front of the floor protector.

The floor protector 10 also has a convex configuration on the upper surface 13 as shown in FIG. 2. This curved top is generally dome-like and allows the floor protector 10 greater flexibility in that it can support the endpin at a broader range of angles.

Figure 5:
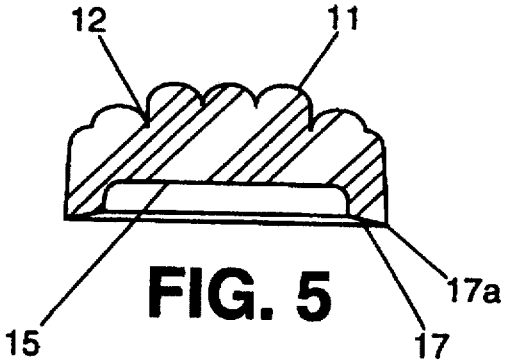

The bottom surface 14 of the floor protector 10 is shown in FIG. 3. The bottom surface 14 may be flat, recessed or concave. The recessed bottom 14 having a narrow rim 17 and central cavity 15 is better able to grip a variety of surfaces, from hardwood floors to carpets, for a variety of reasons. First, the cavity 15 on the bottom surface 14 allows the floor protector to engage the material of the floor surface such as the fibers of a carpet more effectively. Second, the curvature allows for a suction-type effect for the floor protector 10 in part relying on rim 17 to provide a suction cup effect. For example, when the endpin is inserted on the raised supports 11 of the floor protector 10, the entire central portion above cavity 15 is compressed somewhat and air is expelled from the cavity defined by bottom surface 14 of the floor protector 10. This provides a suction-type effect whereby the floor protector 10 is able to grip the floor surface better. For more flexibility and a better suction-cup effect, the rim 17 can be shaped somewhat as shown in FIG. 5 to form a more flexible edge 17*a* for enhanced gripping. All such bottom surfaces functioning as described may be referred to generally as a "concave bottom surface."

Figure 4A:
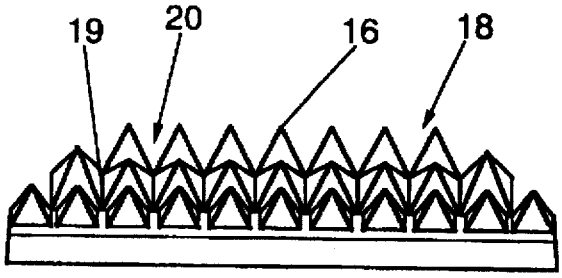
FIGS. 4*a* and 4*b* are approximate side and end views, respectively, of an alternative embodiment of the present invention; and, FIG. 5 is a sectional view of the floor protector taken along the line 5—5 in FIG. 1.

FIG. 4*a* depicts a side view of an alternative floor protector 18. The raised pyramids 16 which crown the upper surface 20 of the floor protector 18 provide improved support for the steel endpin, and reduce the damage to the floor protector 18. The raised pyramids 16 can form multiple supporting areas 19 such that the contour of the supporting area 19 matches that of the endpin.

Figure 4B:
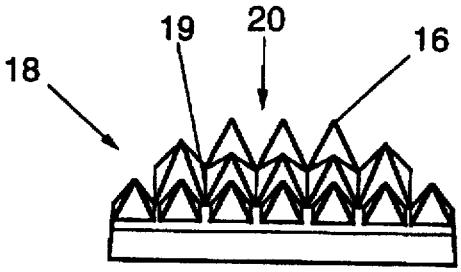

FIG. 4*b* depicts a side view of the alternative floor protector 18. The raised pyramids 16 crown the upper surface 20 of the floor protector and provide improved support for the endpin, thereby reducing the damage to the floor protector 18. Further, the upper surface 20 of the floor protector 18 is convex to provide a broader range of angles of entry for the endpin.

The material used in the floor protector 10 is a non-marring and self-healing material. The floor protector 10 may thus accept the repeated puncture forces of the endpin while still maintaining its effectiveness. Further, the floor protector, due to its non-marring quality, can be used on a variety of surfaces without damage thereto.

Materials which are capable of such qualities are thermoplastic materials which are elastomer. Injected rubber compounds as well as polyvinyl chloride (PVC) materials with appropriate additives perform well. A thermoplastic rubber-like compound used in the floor protector is the DYNAFLEX® G-2712 which is made with KRATON® Polymer. The DYNAFLEX® G-2712, which is manufactured by the GLS Corporation of Cary Ill., exhibits high resilience, good clarity, good puncture resealing characteristics, and a high coefficient of friction. Unlike typical floor protectors with a brass cup, the improved floor protector is composed of a thermoplastic material which helps eliminate the dulling of the endpin when the endpin engages the raised supports 11. Further, the makeup of the thermoplastic material allows the floor protector to be more compact, thereby eliminating the bulky size of the prior art. The floor protector of the present invention is more aesthetically pleasing and can be placed within a bass, cello or bass drum case for ease of transportation. Moreover, the elastomeric material can be made in a variety of colors to improve the appearance of the floor protector. Finally, the thermoplastic material allows the floor protector to be more efficient due to its high coefficient of friction.

What is claimed is:

1. A floor protector comprising a shaped body having an upper surface and a bottom surface wherein the bottom surface is concave, the shaped body having a plurality of raised supports on the upper surface of said body, the upper surface having a dome-like top and the raised supports forming pockets therebetween for supporting an endpin of a musical instrument.

2. The floor protector as defined in claim 1 wherein the raised supports are generally semispherical bumps.

3. The floor protector as defined in claim 1 wherein the raised supports are generally pyramidal.

4. The floor protector as defined in claim 1 wherein the floor protector is composed of a self-healing and non-marring material.

5. The floor protector as defined in claim 4 wherein the floor protector is composed of a thermoplastic material.

6. The floor protector as defined in claim 4 wherein the floor protector is composed of a polyvinyl chloride material.

7. The floor protector as defined in claim 1 wherein the floor protector is composed of rubber.

8. The floor protector as defined in claim 1 wherein the floor protector is composed of an elastomer material.

9. A floor protector for an endpin of a musical instrument comprising a shaped body having a concave bottom surface and a curved dome-like top for supporting the endpin wherein the curved top has a pattern of raised supports.

10. The floor protector as defined in claim 9 wherein the raised supports are semispherical bumps.

11. The floor protector as defined in claim 9 wherein the raised supports are generally pyramidal.

12. The floor protector as defined in claim 9 wherein the floor protector is composed of a generally self-healing and non-marring thermoplastic material.

13. The floor protector as defined in claim 12 wherein the floor protector is composed of a polyvinyl chloride material.

14. The floor protector as defined in claim 12 wherein the floor protector is composed of a rubber material.

15. A floor protector for an endpin of a musical instrument comprising a shaped body having a concave bottom surface for engaging the floor and an upper surface with a pattern of raised supports, said body comprising a non-marring thermoplastic material.

16. The floor protector as defined in claim 15 wherein said upper surface is dome-like.

17. The floor protector as defined in claim 16 wherein the thermoplastic material is a polyvinyl chloride material.

18. The floor protector as defined in claim 15 wherein the material is a rubber material.

19. A floor protector for an endpin of a musical instrument comprising a shaped body having a convex top surface with a pattern of raised supports for supporting the endpin and comprising a self-healing thermoplastic material.

20. The floor protector as defined in claim 19 wherein the shaped body has a concave bottom surface.

21. The floor protector as defined in claim 20 wherein the thermoplastic material is a polyvinyl chloride material.

22. The floor protector as defined in claim 19 wherein the self-healing material is a rubber material.

23. A floor protector comprising means for supporting an endpin of a musical instrument, said supporting means including a shaped body having a plurality of raised supports on the upper surface thereof, the raised supports providing valleys therebetween for supporting an endpin.

24. The floor protector as defined in claim 23 wherein the raised supports are arranged in a pattern.

25. The floor protector as defined in claim 23 wherein the raised supports are generally semispherical.

26. The floor protector as defined in claim 23 wherein the upper surface defined by said supports is a curved dome-like top.

27. The floor protector as defined in claim 23 wherein the floor protector is composed of a thermoplastic material.

28. The floor protector as defined in claim 23 wherein the floor protector is composed of a polyvinyl chloride material.

29. The floor protector as defined in claim 23 wherein the floor protector is composed of a self-healing and non-marring material.

* * * * *